US005265756A

United States Patent [19]

Meier et al.

[11] Patent Number: 5,265,756

[45] Date of Patent: Nov. 30, 1993

[54] PACKAGING TRAY WITH THICK, CURVILINEAR PERIMETER EDGES

[75] Inventors: Carl J. Meier, Lithonia, Ga.; Richard L. Ramirez, Whittier, Calif.

[73] Assignee: Dolco Packaging Corp., Sherman Oaks, Calif.

[21] Appl. No.: 16,624

[22] Filed: Feb. 12, 1993

[51] Int. Cl.[5] ..... B65D 7/42; B65D 1/34

[52] U.S. Cl. ..... 220/659; 206/557; 206/497

[58] Field of Search ..... 220/656, 657, 658, 659; 206/557, 497

[56] References Cited

U.S. PATENT DOCUMENTS 3,578,204 5/1971 Bloch et al. ..... 220/659
3,672,538 6/1972 Wiedemann ..... 220/659
4,048,760 9/1977 Dantzer et al. ..... 220/659
4,355,755 10/1982 Faller ..... 220/659
4,364,477 12/1982 Stromberg ..... 220/659

*Primary Examiner*—Joseph Man-Fu Moy
*Attorney, Agent, or Firm*—Robbins, Berliner & Carson

[57] ABSTRACT

A packaging tray formed of expanded polystyrene foam sheet material, having thick, curvilinearly interrupted perimeter edges. The edges are at least 10% thicker than the cross-sectional thickness of the major portions of the associated side walls of the tray. The perimeter edges are curvilinearly interrupted at at least two regular intervals along each side wall. The walls of the tray form corners which rise from the margins of the bottom panel of the tray at angles which can be greater than the angles at which the side walls rise from the bottom panel margins.

10 Claims, 3 Drawing Sheets

PACKAGING TRAY WITH THICK, CURVILINEAR PERIMETER EDGES

BACKGROUND AND SUMMARY OF THE INVENTION

Packaging trays formed of expanded organic polymer material, such as polystyrene, are used to package a wide variety of food items, from meat to mushrooms, and are usually over-wrapped with a transparent plastic wrap, such as polyvinyl chloride (PVC) shrink-wrap film material, polyethylene chloride (PEC) stretch film, or other similar wrap made of PVC, PEC, or their combination, as well as other commercial shrink wrap or stretch wrap material. Because of different temperature coefficients of expansion between the tray and the wrap material, the wrap tends to loosen following a substantial temperature change. Not only does this provide a poor appearance for goods that must be attractively displayed, but can also result in loss of wrap from the tray with the loss of the contents.

In order to accommodate loosening of the wrap, food packers try to wrap the tray as tightly as possible to the point where the tray walls are bent inwardly so that when the wrap loosens, the outward spring moment of the walls of the tray will maintain tension on the wrap material. However, with packaging trays of standard construction, if the wrap is too tight, tray failure can result by development of side wall cracks or even breakage of the side walls. Such failure can cause the processing equipment to jam. Those trays that survive the processing line are still subject to side wall cracking during handling with resultant looseness of the wrap, thereby defeating the purpose of tightly applying the wrap. Attempting to cure the problem simply by increasing the total thickness of the tray requires greater belt pressure on the sides of the trays in the processing line, with resultant upgrading of capital equipment, and still is not entirely satisfactory in that the resultant tray is often less pliable with lower spring moment so that is does not satisfactorily compensate for loosening of the wrap.

The present invention provides a unique packaging tray construction that overcomes the foregoing drawbacks and permits very tight wrapping of the packaging tray and contents without any increase in belt pressure while maintaining the integrity of the tray walls, resulting in less tray failures during processing and after processing.

The present invention results from the combination of a number of features that normally would be perceived of as unrelated to each other, but synergistically cooperate in the present invention to produce a packaging tray having the aforesaid advantages. As an initial matter, the tray must be rectangular, which can include square shapes, and must have a peripheral edge, features, of course, that are not particularly unique to a packaging tray. What is unique is the combination to be described, a part of which relates to the differential in thickness between the peripheral edge and the major portion of the associated side wall that rises from the bottom panel of the packaging tray. This relationship is defined not only in relative terms but in absolute terms. In a first feature, the peripheral edge of the packaging tray is at least 10% thicker than the cross-sectional thickness of a major portion of the associated wall that terminates in that edge; in a second feature, the peripheral edge has a thickness in the range of 90/1000 inch to 500/1000 inch, preferably 180/1000 inch to 250/1000 inch. In a third feature of the invention, the peripheral edges of the tray's side walls are relieved so as to be curvilinearly interrupted along their lengths at at least two intervals along the length of each side wall peripheral edge, preferably regularly and preferably along at least three intervals. The foregoing combination of features results in a packaging tray having increased strength to enable very tight wrapping while retaining sufficiently high spring moment to maintain a tight wrap and attractive appearance throughout the course of packaging, shipping, and handling.

In a further, particular embodiment, the corners of the packaging containers where the walls meet are formed so as to rise from the bottom panel at a substantially greater angle than the angle at which the walls themselves rise from the panel. While this is not in and of itself a unique feature, its combination with the three features described above enhances the synergistic combination of the other features. Similarly, in another further embodiment, the peripheral side wall edges are cut normal to the plane defined by the bottom panel of the packaging tray. Again, this is not, of itself, unique but its combination with the aforesaid features aids in the synergistic results that are obtained.

DETAILED DESCRIPTION

Figure 5:
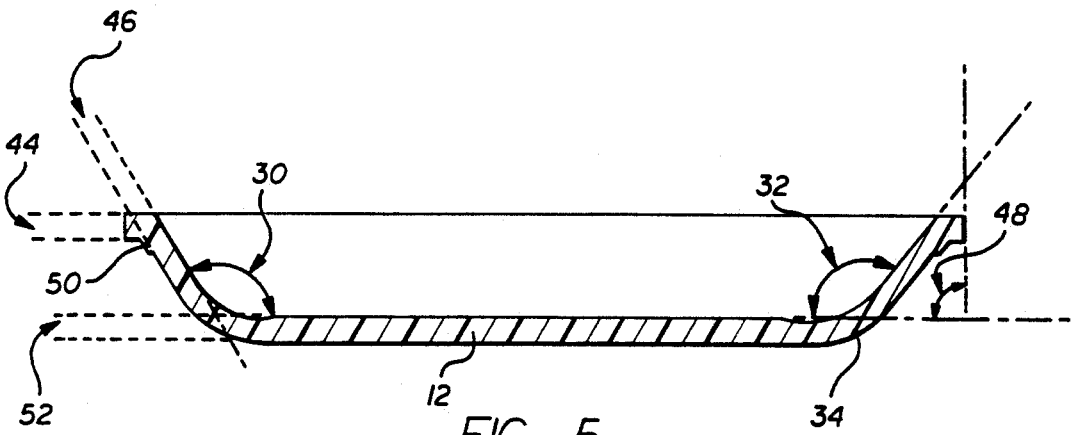
FIG. 5 is a cross-sectional view of the packaging tray taken along lines 5—5 of FIG. 1.

A packaging tray 10 representative of applicant's invention is shown in FIGS. 1 through 4. While the tray has been illustrated as having a particular depth, the invention is equally applicable to trays of substantially greater or lesser depth and for trays which are longer, shorter or square trays. The tray includes a bottom panel 12, a front wall 14, a rear wall 16 opposed to and identical to the front wall 14, and a pair of opposed identical side walls 18 and 20. The side walls 18 and 20 in this embodiment are longer than the front and rear walls 14 and 16 but in other embodiments, they can be shorter. Each of the walls 14, 16, 18, and 20 rise upwardly at an angle 30 from the respective margins 22, 24, 26, and 28 of the bottom panel 12 ranging from 90° to 135°. As shown on the left side of FIG. 5, this angle 30 is defined by extending straight lines along the inner surface of the side walls to intersect a straight line extending the plane of the bottom wall. The corner angles can be equal to the side wall angles or, as shown in FIG. 5, when the side wall angles are obtuse, the angle 32 that each corner 34 of the packaging tray makes as it rises from the margin of the bottom panel 12 can be greater than the angle 30 made by the main body of the walls rising from the bottom panel margin. In this specific embodiment, the angle 30 made by the walls is 122° whereas the angle 32 made by the corner is 131.5°.

Figure 1:
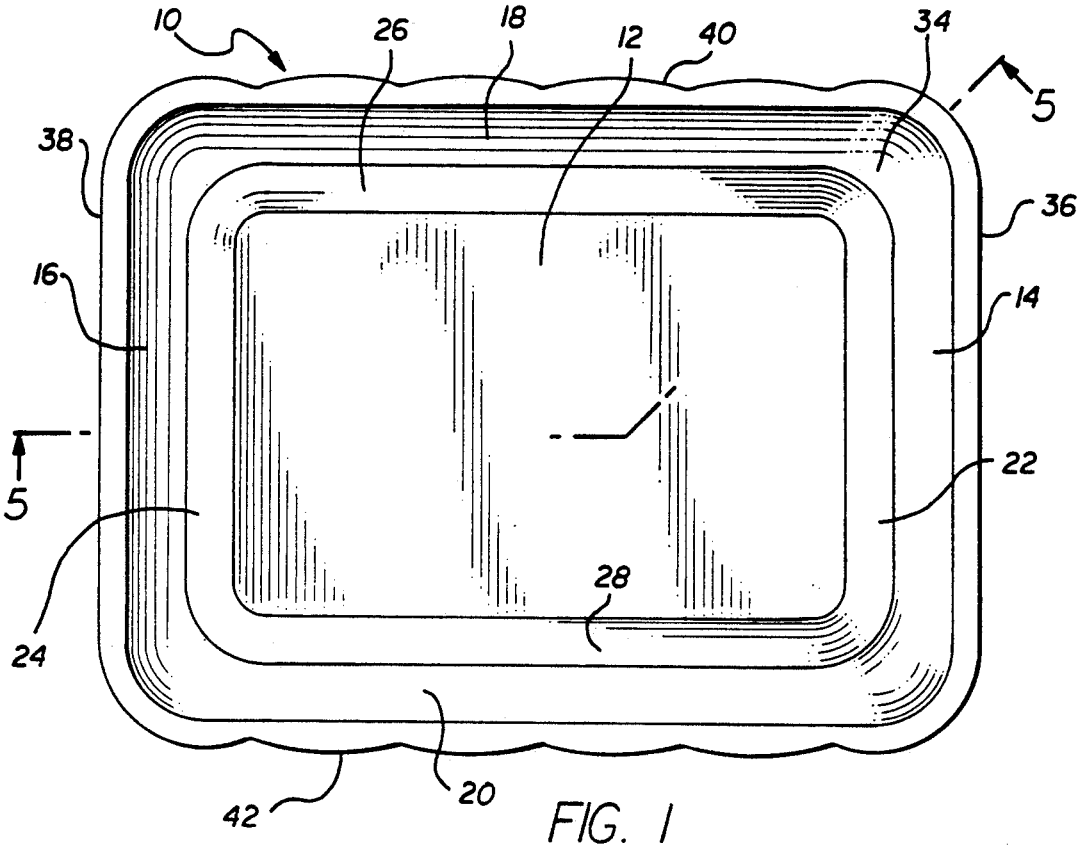
FIG. 1 is a top plan view of a packaging tray of this invention.
Figure 2:
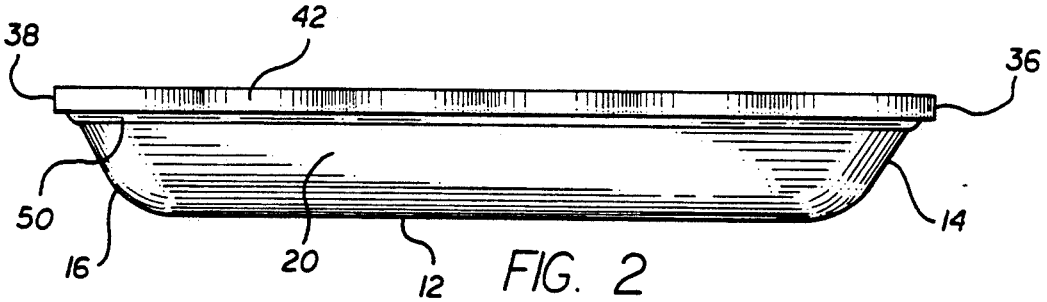
FIG. 2 is a side elevational view of the packaging tray.
Figure 3:
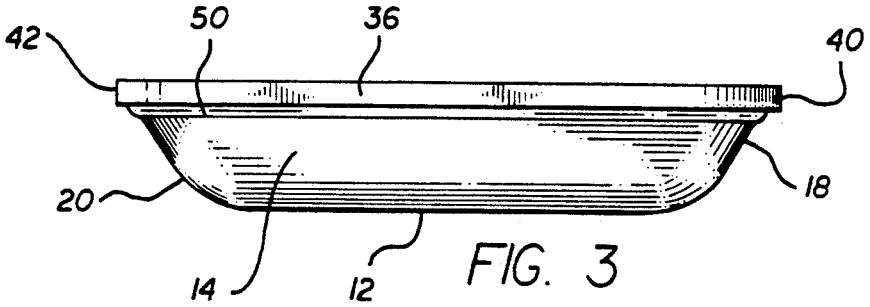
FIG. 3 is a front elevational view of the packaging tray.
Figure 4:
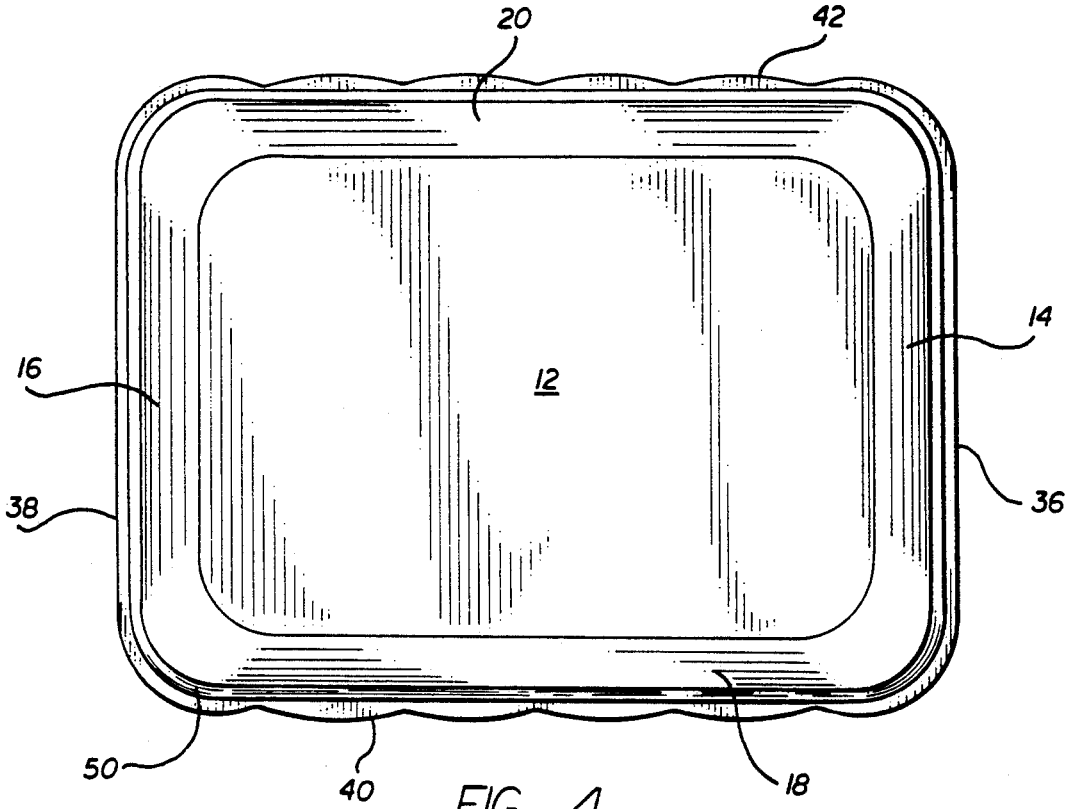
FIG. 4 is a bottom plan view of the packaging tray.

Referring more particularly to FIGS. 2 and 3 in conjunction with FIG. 5, the walls 14, 16, 18, and 20 terminate in respective peripheral edges 36, 38, 40, and 42. As shown most clearly in FIGS. 1 and 4, the side wall peripheral edges 40 and 42 are curvilinearly interrupted along their lengths. In this specific embodiment, the peripheral edges 40 and 42 are relieved so as to be curvilinearly interrupted at four regular intervals along the length of each side wall peripheral edge.

Continuing with FIGS. 2, 3, and 5, particularly FIG. 5, each of the peripheral edges has a thickness dimension 44 which is substantially greater, at least 10%, preferably at least 20%, than the thickness dimension of the major portion of the associated wall. The thickness differential is an important feature not only in relative terms, but also in absolute terms. The thickness dimension should be in the range of about 90/1000 inch to 500/1000 inch, preferably 180/1000 inch to 250/1000 inch with an expanded polystyrene foam sheet material having a molecular weight in the range of from 260,000 to 275,000, a density in the range of 1.5 to 8.5 lbs/ft$^3$, preferably 1.5 to 5 lbs/ft$^3$, a cell size range of 5/1000 to 16/1000 and an orientation range of 75–95%, preferably 80–85%. In addition, as indicated in FIG. 5 at 48, the peripheral edges are cut normal to the plane of the bottom panel 12. Optionally, the greater thickness of each peripheral edge 36, 38, 40, and 42 extends downwardly somewhat down to the associated wall so that a minor portion of each wall adjacent its associated peripheral edge has substantially the same thickness as the peripheral edge, as indicated at 50. Also, the thickness of the bottom panel 12, as indicated at 52, can be substantially the same thickness as the thickness 44 of each of the peripheral edges.

The packaging trays 10 are formed by die cutting by any known mechanism, for example, by using the mechanism described in Braddon U.S. Pat. No. 4,856,393, the disclosure of which is incorporated herein by reference, or by a modified procedure in which a solid backing plate is provided against which the tray is cut. In the Braddon patent, a die cutter is described for cutting product, such as a packaging tray, from a sheet of expanded polystyrene foam material. The die cutter has a rule die blade which defines the shape of the product. In U.S. Pat. No. 4,856,393 the die blade is rectangularly shaped, but in use in forming the packaging tray of this invention, the die blade would be shaped on opposite side wall sides to be periodically curvilinear to match the shape obtained and shown in this invention. The die blade is held by a die holder which has an opening corresponding to the die blade and so the holder would also have to be similarly shaped. The cut packaging tray passes through the die holder.

Figure 6:
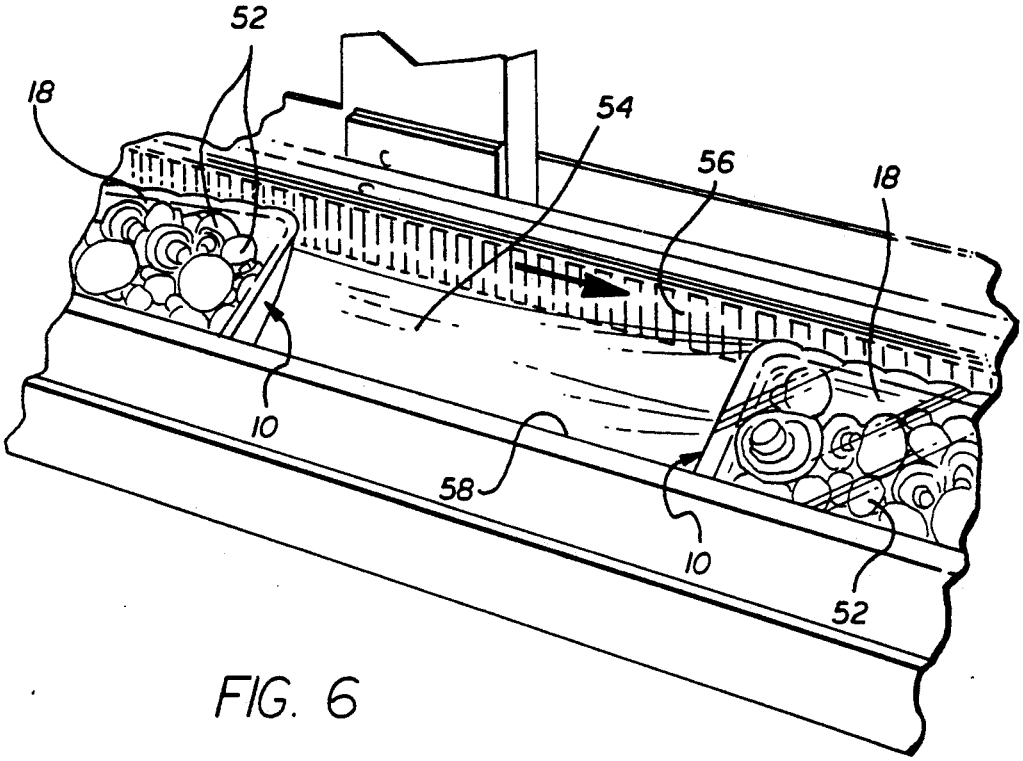
FIG. 6 is a schematic perspective view of a production line showing the shrink-wrapping of a packaging tray of this invention.

Referring now to FIG. 6, there is shown a produce packaging assembly line in which produce, in this case mushrooms 52, are being packaged and wrapped in packaging trays 10 of this invention. The trays, along with the wrap film 54 that has been placed thereover, are carried along between opposing flexible belts 56 and 58. The belts are spaced so as to squeeze together the side walls 18 and 20 so that the wrap film 54 closely adheres to the peripheral edges 40 and 42. The curvilinear interruption facilitates transmission of load bearing compression over relatively short configuration arc periods resulting in alternating deceleration and acceleration of the wrap material over the length of the tray. As the surfaces bow outwardly, the load is accelerated to create a tight wrap. As the curvature bows inwardly, it decelerates, gradually reducing the side wall load on the tray while maintaining a tight wrap.

Figure 7:
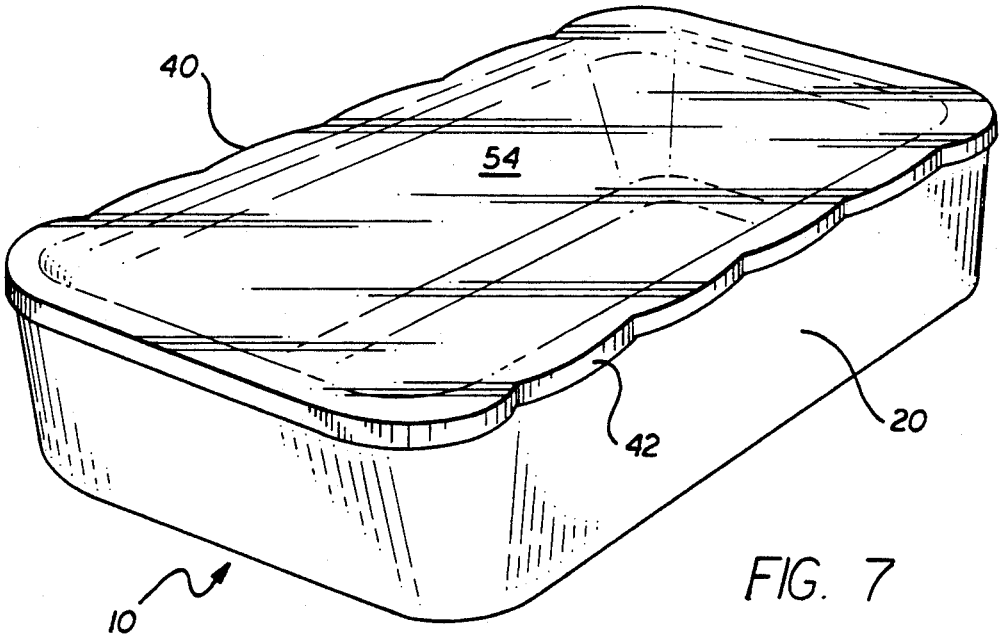
FIG. 7 is a perspective view of a wrapped packaging tray of this invention.

Referring to FIG. 7, the final film wrapped packaging tray is shown (for clarity, without showing the produce), showing the wrap 54 tightly associated with the peripheral edges 40 and 42. The result is a packaging tray having a tight film wrap and improved appearance. Because there is greatly diminished side wall breakage, there is less down time and faster processing speeds. The unique configuration of the instant packaging tray allows less belt pressure to yield a tighter skin wrap. The total result is that there are less tray failures with markedly decreased side wall breakage and side wall cracks. Subsequent to processing, the spring moment permitted by the instant configuration maintains a tight wrap even when there is temperature expansion.

Although the above description has been made with reference to a particularly embodiment of the invention, it will be appreciated that variations and modifications may be made in the above structure without departing from the spirit of the invention.

What is claimed is:

1. In a packaging tray formed of expanded polystyrene foam sheet material, integrally having a generally rectangular bottom member, opposing front and rear walls and opposing side walls and forming corners with said front and side walls, each wall rising upwardly from the respective margin of the bottom member and terminating in an upper, outwardly extending perimeter edge, the improvement according to which the perimeter edge associated with each wall has a thickness in the range of 90/1000 inch to 500/1000 inch and is at least 10% thicker than the cross-sectional thickness of a major portion of the associated wall, the perimeter edges of said walls being curvilinearly interrupted at at least two intervals along their lengths.

2. The improvement of claim 1 in which each of said side wall peripheral edges is curvilinearly interrupted at regular adjacent intervals.

3. The improvement of claim 1 in which there are at least three of said intervals along the length of each side wall peripheral edge.

4. The improvement of claim 1 in which said expanded polystyrene foam material has a molecular weight in the range of from 260,000 to 275,000, a density in the range of 1.5 to 8.5 lbs/ft$^3$, a cell size range of 5/1000 to 16/1000, and an orientation range of 75–95%.

5. The improvement of claim 1 in which the thickness of each perimeter edge is 20% thicker than the cross-sectional thickness of a major portion of its associated wall.

6. The improvement of claim 1 in which a minor portion of each wall adjacent its associated peripheral edge has substantially the same thickness as said peripheral edge.

7. The improvement of claim 1 in which said side walls rise from said bottom member at an obtuse angle and said corners rise from said bottom member at an angle substantially greater than the angle at which said walls rise from said bottom member.

8. The improvement of claim 1 in which said peripheral side wall edges are cut normal to the plane of said bottom member.

9. The improvement of claim 1 in which said perimeter edges each have a thickness in the range of 180/1000 inch to 250/1000 inch.

10. The improvement of claim 4 in which said expanded polystyrene foam material has a density in the range of 1.5 to 5 lbs/ft$^3$ and an orientation range of 80–85%.

* * * * *